US006595618B1

(12) United States Patent
Roy et al.

(10) Patent No.: US 6,595,618 B1
(45) Date of Patent: Jul. 22, 2003

(54) METHOD AND APPARATUS FOR FILLING AND CAPPING AN ACOUSTIC INK PRINTHEAD

(75) Inventors: Joy Roy, San Jose, CA (US); Shahin Sarkissian, San Jose, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/340,938

(22) Filed: Jun. 28, 1999

(51) Int. Cl.[7] ..... B41J 2/165
(52) U.S. Cl. ..... 347/32; 349/29
(58) Field of Search ..... 347/46, 29, 30, 347/32, 7, 85

(56) References Cited

U.S. PATENT DOCUMENTS

| | | | | |
|---|---|---|---|---|
| 4,308,547 A | | 12/1981 | Lovelady et al. | 347/46 |
| 4,697,195 A | | 9/1987 | Quate et al. | 347/46 |
| 4,751,530 A | | 6/1988 | Elrod et al. | 347/46 |
| 4,751,534 A | | 6/1988 | Elrod et al. | 347/46 |
| 4,967,207 A | | 10/1990 | Ruder | 347/7 |
| 5,027,134 A | | 6/1991 | Harmon et al. | 347/46 |
| 5,028,937 A | | 7/1991 | Khuri-Yakub et al. | 347/46 |
| 5,041,849 A | | 8/1991 | Quate et al. | 347/46 |
| 5,471,230 A | * | 11/1995 | Saito et al. | 347/29 |
| 5,504,510 A | * | 4/1996 | Miyakawa | 347/85 |
| 5,565,113 A | | 10/1996 | Hadimiogiu et al. | 216/2 |
| 5,612,721 A | | 3/1997 | Ishize | 347/33 |
| 5,638,099 A | * | 6/1997 | Nguyen et al. | 347/22 |
| 5,644,347 A | | 7/1997 | Schwiebert et al. | 347/33 |
| 5,701,146 A | * | 12/1997 | Akiyama et al. | 347/26 |
| 5,793,390 A | | 8/1998 | Claflin et al. | 347/33 |
| 5,801,735 A | | 9/1998 | Lorenze, Jr. et al. | 347/85 |
| 5,825,380 A | | 10/1998 | Ichizawa et al. | 347/28 |
| 6,010,203 A | * | 1/2000 | Muraki | 347/30 |
| 6,036,299 A | * | 3/2000 | Kobayashi et al. | |

FOREIGN PATENT DOCUMENTS

| | | |
|---|---|---|
| EP | 0 541 519 A2 | 5/1993 |
| EP | 0 676 289 A2 | 10/1995 |
| EP | 0 872 346 A1 | 10/1998 |

* cited by examiner

*Primary Examiner*—Shih-wen Hsieh
(74) *Attorney, Agent, or Firm*—Fay, Sharpe, Fagan, Minnich & McKee, LLP

(57) ABSTRACT

The invention is directed to a method and apparatus utilizing a capping element having a sealing element or gasket which is pushed against the orifice plate of an acoustic ink printhead when capping and filling. This traps a small volume of air around an array of orifices in the orifice plate which prevents ink from exiting the orifices while the printhead is being filled with ink.

21 Claims, 8 Drawing Sheets

METHOD AND APPARATUS FOR FILLING AND CAPPING AN ACOUSTIC INK PRINTHEAD

CROSS-REFERENCE TO RELATED APPLICATIONS

This application is related to U.S. application Ser. No. 09/340,741, entitled "Method and Apparatus for Cleaning/Maintaining of an AIP Type Printhead" by Shahin Sarkissian, Joy Roy and Fereshteh Lesani (filed Jun. 28, 1999), which is incorporated herein by reference.

BACKGROUND OF THE INVENTION

This invention relates to a method and apparatus for filling and capping an acoustic ink printhead. More particularly, the invention is directed to a method and apparatus utilizing a capping element having a sealing element or gasket which is pushed against the orifice plate of an acoustic ink printhead when capping and filling. This traps a small volume of air around an array of orifices in the orifice plate forming an air cushion, enabling the printhead to be filled without any exiting of ink through the orifices.

While this invention is particularly directed to the art of acoustic ink printing (or AIP), and will thus be described with specific reference thereto, it will be appreciated that the invention may have usefulness in other fields and applications. For example, the invention may have application with any type of printhead where a constant flow of a pool of ink is utilized.

By way of background, it has been shown that acoustic ink printers which have printheads comprising acoustically illuminated spherical or Fresnel focusing lenses can print precisely positioned picture elements (pixels) at resolutions that are sufficient for high quality printing of complex images. Significant effort has gone into developing acoustic ink printing, see for example, U.S. Pat. Nos. 4,308,547; 4,697,195; 4,751,530; 4,751,534; 5,028,937; and 5,041,849, all of which are among many commonly assigned to the present assignee.

Although acoustic lens-type droplet emitters currently are favored, there are other types of droplet emitters which may be utilized for acoustic ink printing, including (1) piezoelectric shell transducers, such as described in Lovelady et al., U.S. Pat. No. 4,308,547, and (2) interdigitated transducers (IDTs), such as described in commonly assigned U.S. Pat. No. 4,697,195. Furthermore, acoustic ink printing technology is compatible with various printhead configurations; including (1) single emitter embodiments for raster scan printing, (2) matrix configured arrays for matrix printing, and (3) several different types of page and width arrays, ranging from (i) single row sparse arrays for hybrid forms of parallel/serial printing to (ii) multiple row staggered arrays with individual emitters for each of the pixel positions or addresses within a page width address field (i.e., single emitter/pixel/line) for ordinary line printing.

For performing acoustic ink printing with any of the aforementioned droplet emitters, each of the emitters launches a converging acoustic beam into a pool of ink, with the angular convergence of the beam being selected so that it comes to focus at or near the free surface (i.e., the liquid/air interface) of the pool. Moreover, controls are provided for modulating the radiation pressure which each beam exerts against the free surface of the ink. That permits the radiation pressure from each beam to make brief, controlled excursions to a sufficiently high pressure level to overcome the restraining force of surface tension, whereby individual droplets of ink are emitted from the free surface of the ink on command, with sufficient velocity to deposit them on a nearby recording medium.

A main attraction of acoustic ink printing is the ability to control droplet size based on the frequency of the signal provided, rather than relying on the size of the nozzle emitting the droplet. For example, an AIP printer may emit droplets that are magnitudes smaller in size than the orifice openings through which the droplets are emitted. On the other hand, conventional ink jet printing requires a minimization of the nozzle itself to obtain small droplets.

Acoustic ink printheads possess a variety of features that constitute significant distinctions over traditional printheads. For example, ink jet printheads typically have segmented ink reservoirs (or individual ink compartments) for each ink ejector or nozzle. Each compartment also has separate inlets for ink. Similar configurations are found in piezeoelectric and bubble jet type printheads.

Conversely, consistent with the basic functions of acoustic ink printheads as described above, acoustic ink printheads are generally compartmentless printheads that utilize a common pool of flowing ink instead of separate ink compartments. Focusing of a sound beam in such pool is an important feature of acoustic ink printing so the pool of ink is typically very shallow.

In addition, it is desirable to be able to rapidly fill and drain acoustic ink printheads. However, a difficulty in rapidly filling the printhead is that the path through which the shallow pool of ink ultimately flows is very resistive. As such, during filling, there is a high probability that liquid will undesirably escape from the orifices instead of completing a preferred recirculating flow circuit through the printer. Such a preferred recirculating flow circuit involves the flow of ink from an ink reservoir so that it flows to the printhead and over the droplet emitters of the printhead. Of course, select amounts of ink may be emitted as generally described herein but excess ink will preferably flow back to the ink reservoir for re-use. Thus, prevention of this undesired phenomena of ink loss through the orifices and a lack of completion of the recirculating ink flow circuit is important to the filling process. The problem takes on increased significance in view of the fact that a simple acoustic ink printer with recirculating ink flow will not always have power supplied thereto at which time the printhead drains off ink—so the printheads require filling on a regular basis (e.g. each time the printer is turned on).

One contemplated solution is simply to physically block the apertures or orifices from which the ink is emitted. However, the array of apertures is very fragile and pressing on the array might deform the printhead. Any such deformation, no matter how slight, might have a significant impact on print quality. That is, acoustic ink printing requires very precise focusing of sound waves on the surface of the pool of ink. Accordingly, if this surface is moved or altered as a result of deformation of the plate, proper focusing may be negated.

Thus, the present invention contemplates a new method and apparatus for filling and capping an acoustic ink printhead that overcomes the heretofore known difficulties.

SUMMARY OF THE INVENTION

A method and apparatus for filling and capping an acoustic ink jet printhead is provided.

In one aspect of the invention, the method comprises aligning/positioning the printhead relative to a capping element, moving a sealing element positioned on the capping element into engagement with the printhead such that the sealing element touches the printhead but transmits substantially no force on the printhead, exerting a force on the sealing element to seal the reservoir such that the force is transmitted to the printhead through the sealing element, establishing ink flow in the printhead, removing the force on the capping element to remove the force on the printhead, and moving the sealing element out of engagement with the printhead.

In a more limited aspect of the invention, the method further comprises selectively opening and closing an air vent valve in the chamber of the capping element.

In another aspect of the invention, the apparatus comprises 1) a plurality of capping elements—each capping element comprising a first body portion having an air chamber defined therein, a vent valve disposed in the air chamber and a shoulder portion positioned on a periphery of the air chamber, a sealing element positioned on the shoulder, a second body portion upon which the first body portion is resiliently mounted, and a third body portion extending from the second body portion, 2) a base element having a plurality of shaft holes defined therein and a corresponding plurality of shaft collar elements circumferentially aligned to the shaft holes and sized to receive respective shaft portions, and 3) a drive mechanism operatively engaged to the third body portions.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention exists in the construction, arrangement, and combination of the various parts of the device and steps of the method, whereby the objects contemplated are attained as hereinafter more fully set forth, specifically pointed out in the claims, and illustrated in the accompanying drawings in which:

DETAILED DESCRIPTION OF THE PREFERRED EMBODIMENTS

Figure 1:
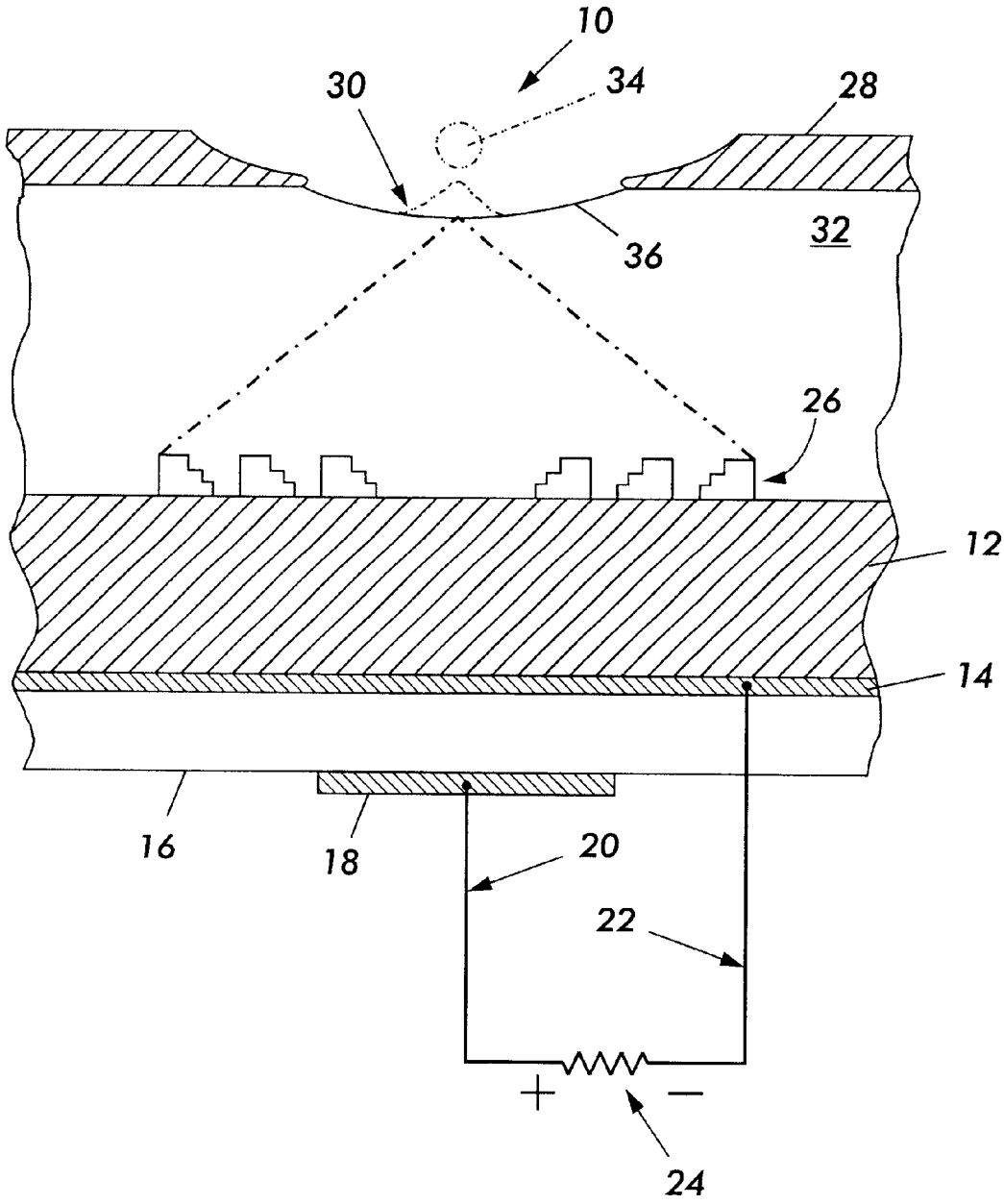
FIG. 1 is a representative illustration of an acoustic ink printing element to which the present invention may be applied.

FIG. 1 provides a view of an exemplary acoustic ink printing ejector 10 to which the present invention is directed. Of course, other configurations may also have the present invention applied thereto. Additionally, while a single ejector is illustrated, an acoustic ink printhead will consist of a number of the ejectors arranged in an array configuration on a printhead, and the present invention is intended to work with such a printhead(s).

As shown, ejector 10 includes a glass layer 12 having an electrode 14 disposed thereon. A piezoelectric layer 16, preferably formed of zinc oxide, is positioned on the electrode layer 14 and an electrode 18 is disposed on the piezoelectric layer 16. Electrode layer 14 and electrode 18 are connected through a surface wiring pattern representatively shown by lines 20 and 22 to a radio frequency (RF) power source 24 which generates power that is transferred to the electrodes 14 and 18. On a side opposite the electrode layer 14, a lens 26, such as a concentric Fresnel lens, or other appropriate lens, is formed. Spaced from the lens 26 is a liquid level control plate (also called an orifice plate) 28 having an orifice or aperture 30 formed therein. Ink 32 is retained between the orifice plate 28 and the glass layer 12. The orifice 30 is aligned with the lens 26 to facilitate emission of a droplet 34 from ink surface 36. Ink surface 36 is, of course, exposed by the orifice 30.

The lens 26, the electrode layer 14, the piezoelectric layer 16 and the electrode 18 are formed on the glass layer 12 through photolithographic techniques. The orifice plate 28 is subsequently positioned to be spaced from the glass layer 12. The ink 32 is fed into the space between the orifice plate 28 and the glass layer 12 from an ink supply (not shown but such supply is well known in the art).

Figure 2:
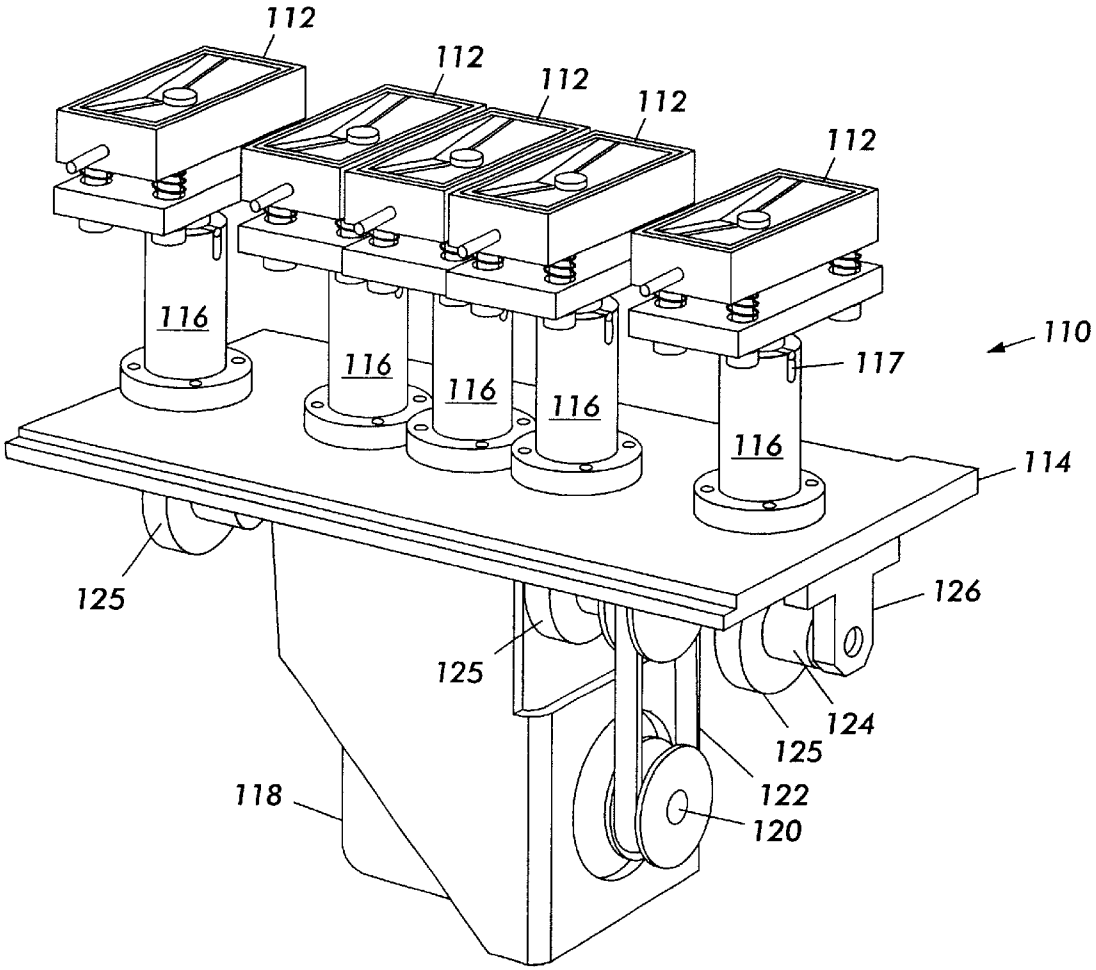
FIG. 2 is a perspective view of a capping and filling station according to the present invention.

Referring now to FIG. 2, a capping and filling station 110 is shown. This station 110 could be positioned at any convenient location within an acoustic ink printer (not shown); however, preferably, the station 110 is disposed in a position and oriented such that printheads that are supported on a carriage (not shown) within the printer align with the station 110 when the carriage and printheads are in a "parked" or standby mode.

As illustrated, the capping and filling station 110 comprises a plurality of capping elements 112, a base portion 114 having shaft holes (not in view) with collar elements 116 extending therefrom, and a drive mechanism or motor 118. The drive motor 118 operatively engages the capping elements 112 through rotation of drive shaft 120 which has connected thereto a drive belt 122. The belt 122 is also operatively engaged with cam shaft 124, having cams such as those shown at 125, that is positioned under the base 114 by support brackets 126.

The drive motor 118, drive shaft 120, drive belt 122 and cam shaft 124 may take a variety of forms to accomplish the goals of the present invention. Preferably, though, the drive motor 118 is a stepper motor and the cam shaft 124 is configured such that a full revolution thereof facilitates the capping and filling procedure to be hereafter described in connection with FIGS. 5(*a*) through 5(*f*).

It should also be recognized that the drive motor 118 could be replaced with other automated or manually operated devices. For example, the belt and drive motor could be replaced by simply attaching a lever to the cam shaft to serve as the drive mechanism so that the cam shaft is manually rotated.

It should be further recognized that the drive motor and shaft, drive belt, and cam shaft and support brackets, as well as the base portion 114 and its components, should all be formed of material that is compatible with the efficient operation of the printer yet sufficiently durable to provide longevity to the system.

Figure 3:
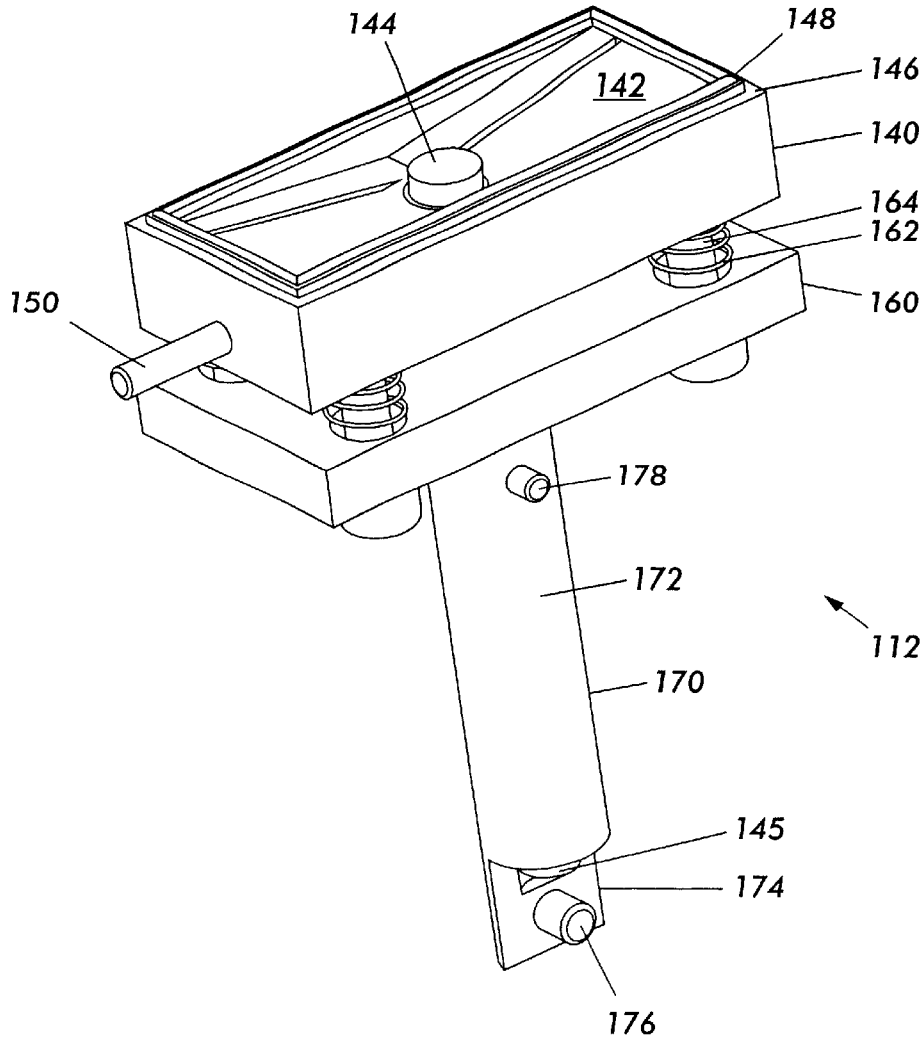
FIG. 3 is a perspective view of a capping element of the capping and filling station shown in FIG. 2.

With reference now to FIG. 3, an individual capping element 112 is shown. A first body portion 140 has a recess or chamber 142 defined therein and an air vent 144 disposed in the chamber. The vent valve 144 also has a shaft or rod having an opposite end 145. Around the periphery of the reservoir 142 is a shoulder portion 146. The shoulder portion 146 has disposed thereon a sealing or gasket element 148. A drain tube 150 is also provided to the first body portion 140.

A second body portion 160 is also shown. The second body portion 160 has gimbal mounted thereon the first body portion 140. Gimballing is provided by spring mechanisms 162 that are disposed between the first and second body portions. The spring mechanisms 162 are also disposed around guide-shafts 164 which enable vertical motion with gimballing adjustment between the body portions.

A third body or shaft portion 170 is also provided to the capping element 112. The shaft portion 170 is preferably hollow through portion 172 and includes a substantially flat end portion 174 having cam follower member 176 disposed thereon. Also provided to the shaft portion 170 is a pin member 178 that is sized to be received in a slot 117 on collar element 116 (FIG. 2).

Figure 4:
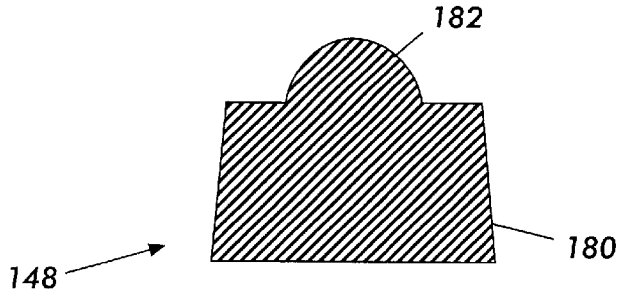
FIG. 4 is a cross-sectional view of a sealing element according to the present invention.
Figure 5A:
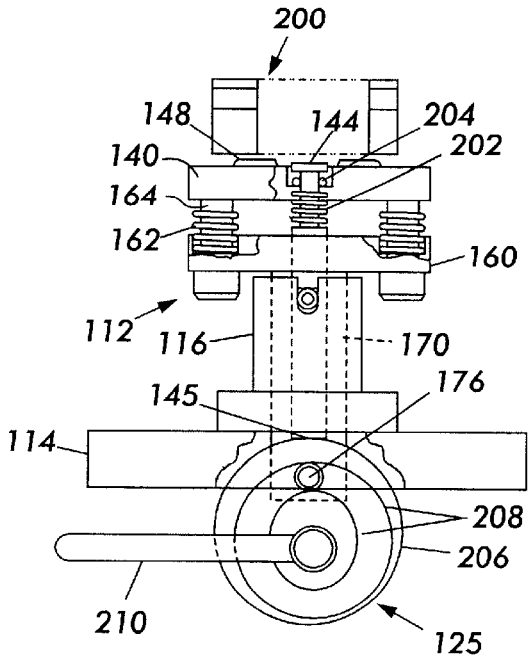
FIGS. 5(*a*)–(*f*) show the capping and filling method and apparatus according to the present invention.
Figure 5B:
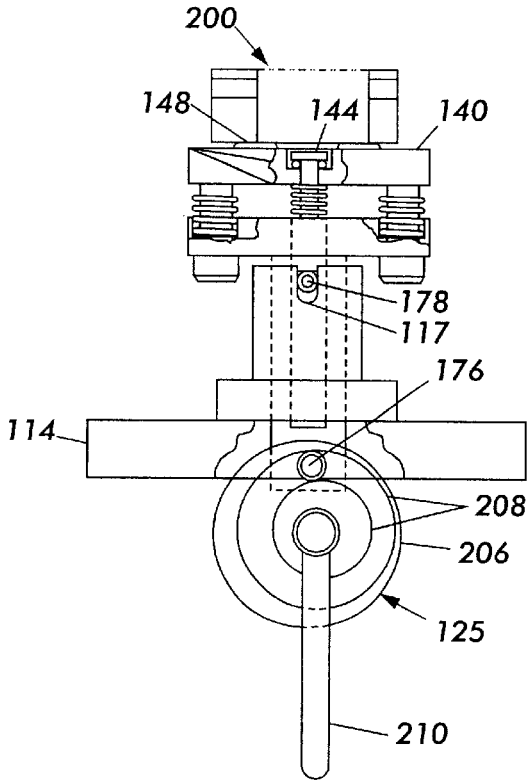
Figure 5C:
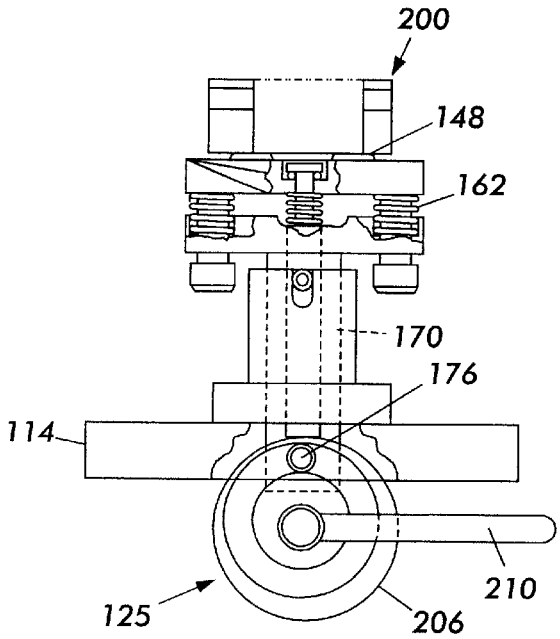
Figure 5D:
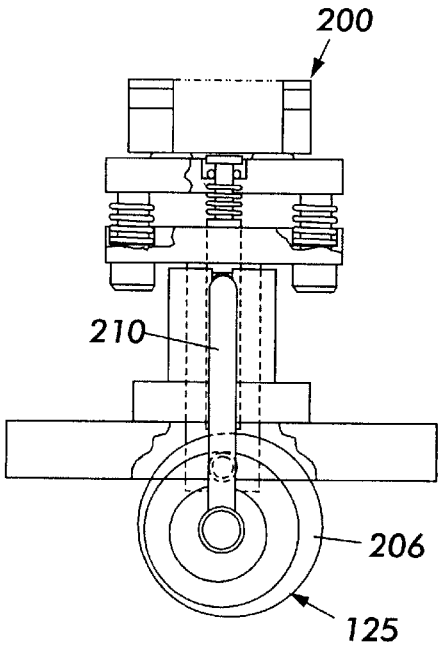
Figure 5E:
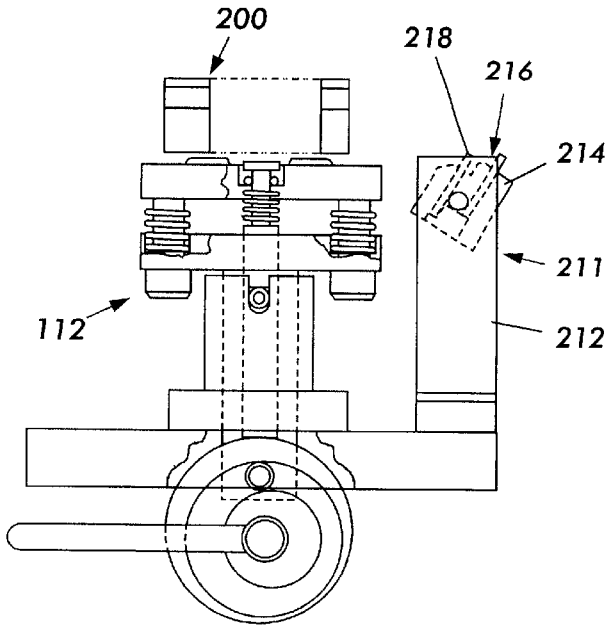
Figure 5F:
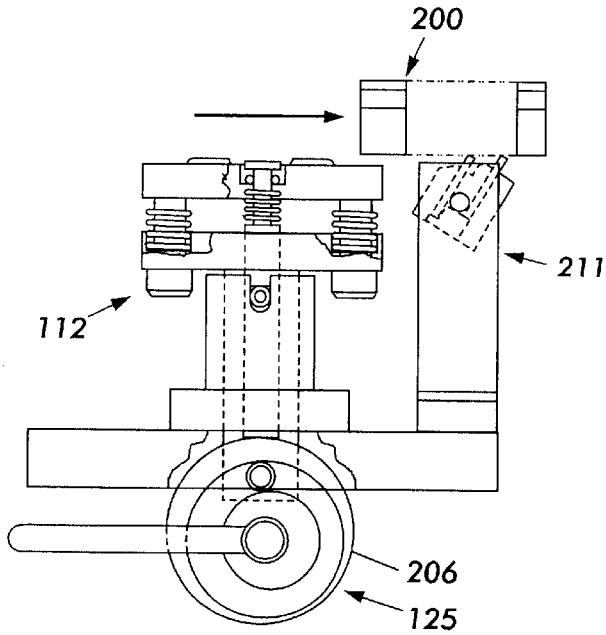

FIG. 4 shows a cross-sectional view of the sealing element 148. Preferably, as shown, the sealing element 148 has a base portion 180 that has a substantially rectangular cross-sectional shape and an arcuate portion 182 disposed thereon. The arcuate portion 182 includes the surface that ultimately engages the printhead.

It should be appreciated that the capping element 112 may take a variety of forms, provided that any such form facilitate achieving the goals of the present invention. For example, the spring mechanisms 162 and guide shafts 164 may be replaced by suitable elastomer pads or a single spring that provides equivalent force and gimballing when desired.

In addition, the components may be formed of any suitable material that will be apparent to those skilled in the art. However, it should also be noted that the material used should also be compatible with the ink that is emitted from the printhead, where appropriate. In this regard, to avoid leaking, for example, the sealing element 148 should be formed of a material that will not absorb the ink.

Having thus described the basic structural configuration of the capping and filling station 110, the process for actually capping and filling will now be set forth. Referring to FIGS. 5(*a*–5(*e*), the printhead 200 is shown in alignment with the capping element 112. It will be appreciated by those skilled in the art that the printhead 200 is preferably positioned on a printhead carriage along with other printheads. The printheads are spaced on the carriage to correspond to the spacing of the capping elements 112 (as shown in FIG. 1). When the printer is in use, the carriage is selectively moved along a track or rail and the printheads selectively emit ink onto paper at specific locations according to control parameters that are beyond the scope of this description. However, when the printer is not printing, the carriage is parked, or placed in a standby mode, so that the printheads are aligned with the capping elements 112.

In FIG. 5(*a*), the printhead is shown to be aligned with the capping element 112, however, the printhead is uncapped. Note that the vent valve 144 is shown in an open state. In this view, it is apparent that the valve 144 has disposed around its rod or shaft a spring mechanism 202 and an O-ring sealing element or gasket 204. It can also be seen that the rod of the valve 144 goes through the center of the hollow shaft portion 170 with the opposite end 145 (also shown in FIG. 3) sitting on the outer cam surface 206. As shown, cam 125 (also shown in FIG. 2) includes the cam surfaces 206 and 208. It should be recognized that the surfaces 208 and 206 are configured to facilitate movement and relative movement of the third body portion 170 and the end 145 of the rod of the valve 144, respectively, as will be described herein. While exemplary shapes of the surfaces 208 and 206 are shown, any contours that accomplish the objectives of the present invention will suffice.

Those skilled in the art will appreciate that the orientation of the cam shaft is rotated 90 degrees in FIGS. 5(*a*)–5(*f*) when compared to FIG. 2. The orientation shown in FIGS. 5(*a*)–5(*f*), however, allows for more convenient explanation of the method disclosed herein. It should be appreciated that any orientation of the cam shaft that fulfills the requirements of the invention may be implemented. In addition, an alternative embodiment to that described in connection with FIG. 2 is shown. That is, the drive motor 118, drive shaft 120 and drive belt 122 are replaced by a manually operated lever 210.

Referring now to FIG. 5(*b*), the cam 125 is rotated and cam follower element 176 follows the cam surfaces 208 so that the third body portion 170 is moved in a vertical direction upward so that the sealing element 148 touches, but does not transmit any substantial force to, the printhead 200. It should be appreciated that the sealing element 148 preferably surrounds the emitter array of the printhead but does not touch the array itself. In FIG. 5(*b*), it is also apparent that, while the first body portion 140 is moved in the same vertical direction toward the printhead, the vent valve 144 becomes closed due to the spring 202 around the rod and/or the relative movement of the portion 170. Note that the valve 144 is seated against the O-ring sealing element 204 and the spring 202 is in an altered state of compression.

At this point, the printhead is capped and substantially protected from the environment of the printer in that paper dust and other undesired contaminants are prevented from coming into contact with the emitter array elements of printhead 200. Depending on the needs of the user, this stage of the capping process may be assumed during an OFF or standby mode. However, it should be noted that the sealing element in this stage is not fully sealing the reservoir and emitter array. In this stage, moisture might still be able to enter the reservoir.

Referring now to FIG. 5(*c*), the cam 125 is further rotated such that the cam follower element 176 moves the third portion 170 further in the vertical direction such that a substantial force is transmitted by the spring mechanisms 162 to the printhead 200 through the sealing elements 148 which are compressed. The vent valve remains closed in this position. As such, the printhead is capped and is fully protected from elements of the environment, including moisture. Therefore, this may be a stage at which the user desires the printhead to be capped when the printer is in an OFF or standby mode.

At this stage, the flow of ink can be initiated to fill the printhead and complete the recirculating flow circuit. Typically, in order to remove the air from the tubing that delivers the ink to the printhead, the ink flow rate has to be above a minimum amount. At this typical flow rate, during the course of filling, the ink pressure in the orifice region of the acoustic ink jet printheads of the type described will reach a high pressure point anywhere between 0.08 to 0.24 psi (above ambient) because of the flow impedance of the printhead and also because of the geometric (vertical) layout of the fluid circuit. Based upon static results on typical orifices used in acoustic ink printing (equivalent diameter of 100 microns) for inks having a high surface tension coefficient (greater than 45 degrees/cm), spill out of ink from the orifices can occur if the pressure inside the orifice is above ambient pressure (or above −0.02 psi with respect to ambient). In order to fill these printheads with a maximum pressure above the spill threshold of 0.26 psi without exiting of any ink from the orifices, the capping has to provide a certain level of seal strength and a certain level of stiffness of the air-cushion. The required level of seal strength will allow no air-leak up to 2.0 psi (greater than 7 times filling pressure above threshold) and the level of air cushion stiffness achieved by an air chamber volume (between the orifice plate and the sealed cap) is less than $2.0\times10^{-4}$ $inch^3$ (less than $7.5\times10^{-5}$ $inch^3$/psi of volume per spill pressure above threshold) per nozzle. The required seal strength can be achieved by choosing a compliant material (low durometer) for the seal 148 with a small nip width for the portion 182 and pressing it onto the printhead with sufficient force. For the embodiment described in the figures, when the orifice array is about 1.7" long by 0.20" wide, the cap seal material has a durometer of 45 shore A, a nip width of 0.015" and a force of engagement to the printhead greater than 4.0 lbf. It can be appreciated that as the maximum fill pressure above spill threshold increases/decreases, the capping will require levels of seal-strength and air cushion stiffness to increase/decrease accordingly.

Once the ink is flowing in the printhead 200, the air cushion may be relieved and the printhead uncapped. However, it is important that the capping element 112 not be abruptly pulled away from the printhead so that an undesired suction force is generated. If a suction force is so generated, there is a high probability that the flowing ink will flow out through the orifices and stop flowing within the printhead and back through the recirculating ink path. Therefore, as shown in FIG. 5(*d*), the cam 125 is further rotated so that the compression force is removed from the printhead (but the sealing element remains in contact with the printhead) and the vent valve is opened. Relative to the first body portion 140, the vent valve is opened toward the printhead, thus avoiding any suction force pulling the ink out through the orifices.

FIG. 5(*e*) shows the cam 125 rotated back to the original position shown in FIG. 5(*a*) such that the capping element 112 is no longer capping the printhead 200. FIG. 5(*e*) also shows an optional wiper system (not shown in FIGS. 5(*a*)–5(*d*)) that is positioned to wipe the bottom surface of the printhead for cleaning purposes. The wiper structure 211 includes a support structure 212, a wiper frame 214 and wiper blades 216 and 218. As shown in FIGS. 5(*e*)–5(*f*), as the printhead 200 is moved out of alignment with the capping elements 112 by way of the above-mentioned printhead carriage, the wiper blades 216 and 218 engage the surface of the printhead to wipe excess ink therefrom.

This is a particularly advantageous feature when the capping and filling station is utilized to flood the printhead as a first step in a more elaborate cleaning procedure—as is more particularly described in co-pending U.S. application Ser. No. 09/340,741, entitled "Method and Apparatus for Cleaning/Maintaining of an AIP Type Printhead" by Shahin Sarkissian, Joy Roy and Fereshteh Lesani (filed Jun. 28, 1999), incorporated herein by this reference.

As described therein, in seeking a manner of appropriately cleaning acoustic ink printheads such as those having an orifice plate 28 depicted in FIG. 1, applicants have enlisted the physical component of the capping element 112. The capping element 112 can be used for rapidly flooding an acoustic ink jet printhead, in a manner similar to that shown in FIGS. 5(*a*)–5(*f*), for such cleaning.

More particularly, capping element 112 is used in a first step of cleaning an acoustic ink printhead, such as comprised of a plurality of ejectors 10 previously described. As shown in FIGS. 5(*a*)–5(*c*), capping element 112 is moved into alignment with printhead array in a manner known within the art. Next, as shown, capping element 112 is engaged with printhead such as to form a seal. For the cleaning operation of the present invention, once the dirty printhead is capped, the ink pressure in the printhead is increased significantly to allow ink to escape through the orifices and completely fill a small reservoir 142 inside the capped structure. It is to be appreciated that increasing ink pressure within the printhead is a known technique and accomplishable by one of skill in the art and understanding of acoustic ink printing. Once the pressure has been increased to move the ink through the orifice structures, the orifices may be allowed to soak for a predetermined time period in order to attempt to dissolve dried ink and loosen dust debris. After a predetermined time period, the vent valve is opened which allows the ink to drain out of the cap through the drain port 150. While the drain nozzle 150 is in an open position, the ink pressure inside the printhead is moved to an intermediate high level. This pressure prevents the ink still remaining inside each orifice from reentering the printhead. Following this operation, the outside surface of the orifice plate may be cleaned off by wiping with the wiper blades 216, 218 or 240 as disclosed herein.

Figure 6:
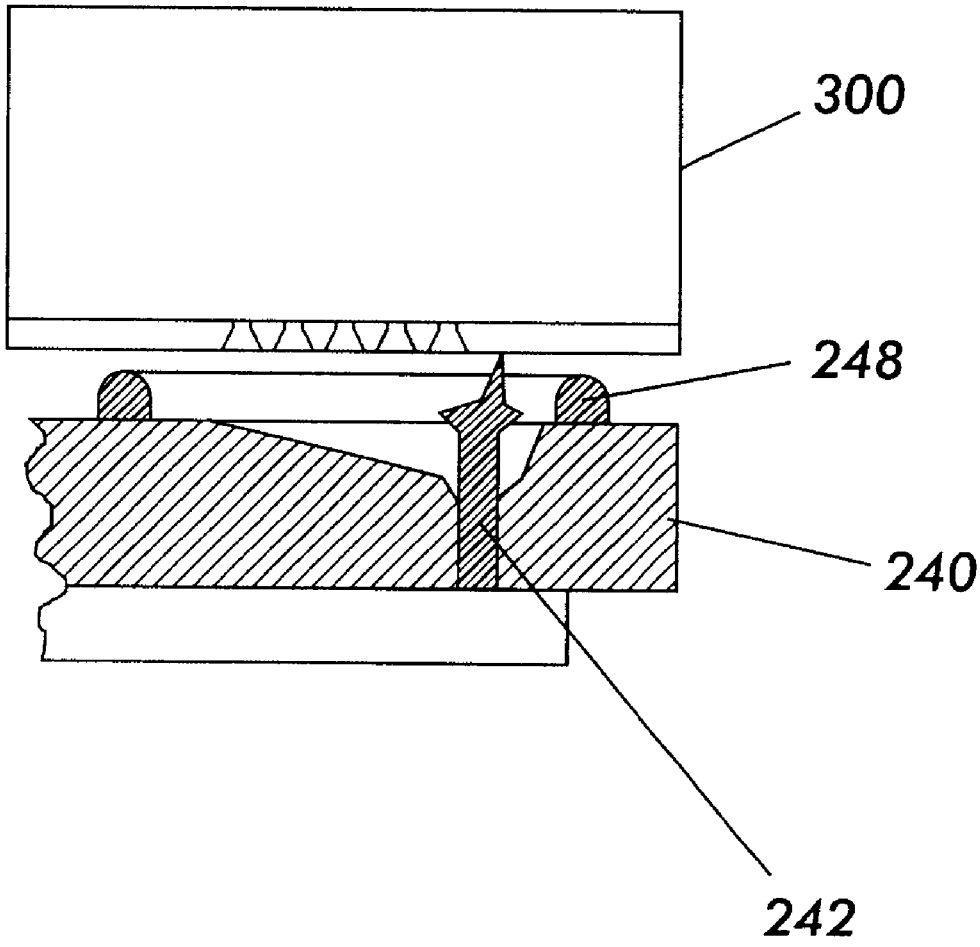
FIG. 6 is a cross-sectional view of an alternative embodiment of the present invention; and, FIG. 7 is another view of the alternative embodiment shown in FIG. 6.

Referring now to FIG. 6, an alternative embodiment is shown whereby the vent valve is replaced with a dual purpose vent valve and wiper blade. As shown, the valve/wiper blade 242 is provided to the capping element 240 within the boundary of the sealing element 248. It is to be appreciated that when desired, the valve/wiper blade is simply opened or extended toward the printhead so that it engages the surface of the printhead to wipe excess ink therefrom. When wiping is not desired, the valve/wiper blade is retracted to a "valve open" or "vale closed" state depending on the stage of the capping and filling procedure being implemented.

Figure 7:
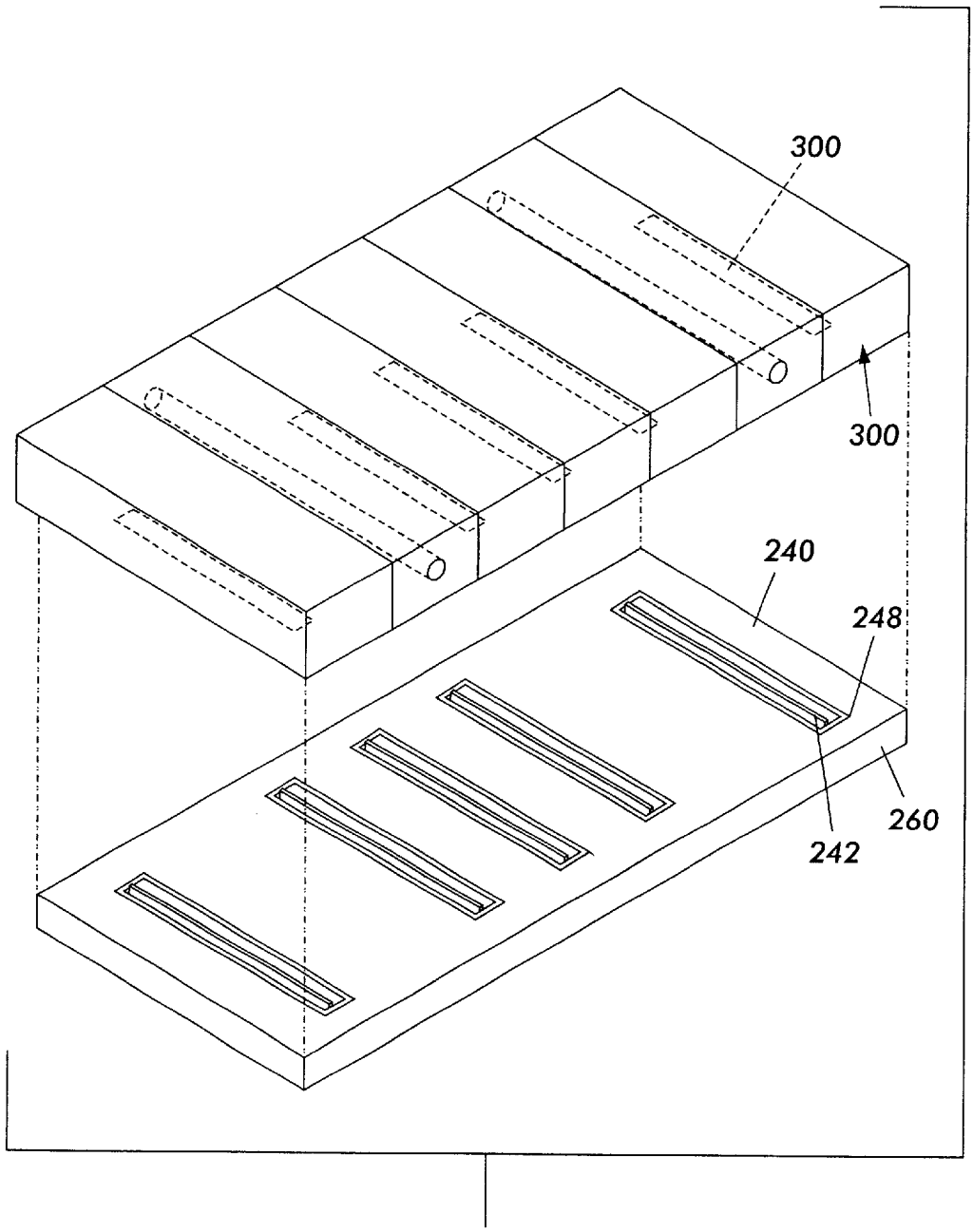

As shown in FIG. 7, a capping element 240 is disposed in a base portion 260 that accommodates other similar capping elements. Further, the wiper blade 242 extends across the full length of the recess of the capping element 240 within the boundaries of the sealing element 248. Also shown in FIG. 7 is printhead 300 having emitter element arrays 302 disposed therein. Of course, these arrays ultimately align with the capping elements 240 during the capping and filling procedure.

The above description merely provides a disclosure of particular embodiments of the invention and is not intended for the purpose of limiting the same thereto. As such, the invention is not limited to only the above described embodiments. Rather, it is recognized that one skilled in the art could conceive alternative embodiments that fall from the scope of the invention.

Having thus described the invention, we hereby claim:

1. A method for filling an acoustic ink printhead with ink at a capping and filling station comprising at least one capping element having a chamber defined therein and a sealing element disposed around a periphery of the chamber, the method comprising steps of:

aligning the printhead with the capping element;

moving the sealing element of the capping element into engagement with the printhead such that the sealing element touches the printhead but transmits substantially no force on the printhead;

exerting a force on the sealing element to seal the chamber such that the force is transmitted to the printhead through the sealing element and to generate an air cushion within the chamber thereby facilitating establishing the ink flow;

establishing ink flow in the printhead;

removing the force on the capping element to remove the force on the printhead; and, moving the sealing element out of engagement with the printhead.

2. The method as set forth in claim 1 wherein the air cushion per nozzle is less than $7.5\times10^{-5}$ $inch^3$/psi (volume per filling pressure above threshold).

3. The method as set forth in claim 1, wherein exerting the force on the sealing element comprises further moving the capping element in the vertical direction such that the force is transmitted through the sealing element from spring mechanisms disposed within the capping element.

4. The method as set forth in claim 1 wherein the vent valve is closed after moving the sealing element into engagement with the printhead and opened after ink flow is established.

5. A method for filling an acoustic ink printhead with ink at a capping and filling station comprising at least one capping element having a chamber defined therein and a sealing element disposed around a periphery of the chamber, the method comprising steps of:

aligning the printhead with the capping element;

driving a belt connecting a drive motor to a cam shaft that is connected to the capping element such that the cam shaft rotates and moves the capping element in a vertical direction moving the sealing element of the capping element into engagement with the printhead such that the sealing element touches the printhead but transmits substantially no force on the printhead;

exerting a force on the sealing element to seal the chamber such that the force is transmitted to the printhead through the sealing element;

establishing ink flow in the printhead;

removing the force on the capping element to remove the force on the printhead; and, moving the sealing element out of engagement with the printhead.

6. The method as set forth in claim 5 wherein removing the force and moving the sealing element out of engagement comprises further rotating the cam shaft such that the capping element moves in an opposite vertical direction.

7. A method for filling an acoustic ink printhead with ink at a capping and filling station comprising at least one capping element having a chamber defined therein, a vent valve positioned in the chamber, and a sealing element disposed around a periphery of the chamber, the method comprising steps of:

aligning the printhead with the capping element;

moving the sealing element of the capping element into engagement with the printhead such that the sealing element touches the printhead but transmits substantially no force on the printhead;

exerting a force on the sealing element to seal the chamber such that the force is transmitted to the printhead through the sealing element;

establishing ink flow in the printhead;

removing the force on the capping element to remove the force on the printhead;

moving the sealing element out of engagement with the printhead; and, selectively opening and closing the vent valve positioned in the chamber.

8. A method for filling an acoustic ink printhead with ink at a capping and filling station comprising at least one capping element having a chamber defined therein and a sealing element disposed around a periphery of the chamber, the method comprising steps of:

aligning the printhead with the capping element;

rotating a lever connected to a cam shaft that is connected to the capping element such that the cam shaft rotates and moves the capping element in a vertical direction;

moving the sealing element of the capping element into engagement with the printhead such that the sealing element touches the printhead but transmits substantially no force on the printhead;

exerting a force on the sealing element to seal the chamber such that the force is transmitted to the printhead through the sealing element;

establishing ink flow in the printhead;

removing the force on the capping element to remove the force on the printhead; and, moving the sealing element out of engagement with the printhead.

9. A capping and filling apparatus useful in connection with printheads employed in acoustic ink printers, the apparatus comprising:

a plurality of capping elements, each capping element comprising a first body portion having a chamber defined therein, a valve disposed in the chamber and a shoulder portion positioned on a periphery of the chamber, a sealing element positioned on the shoulder, a second body portion upon which the first body portion is gimbal mounted, and a third body portion comprising a first shaft within a second hollow shaft extending from the second body portion;

a base element having a plurality of shaft apertures defined therein and a corresponding plurality of collar elements circumferentially extending from the apertures and sized to receive the third body portions; and, a drive mechanism operatively engaged to the third body portions.

10. The apparatus as set forth in claim 9 wherein the first body portions are resiliently mounted on the second body portions through spring mechanisms.

11. The apparatus as set forth in claim 10 wherein the drive mechanism is a motor that is operatively engaged to the third body portions through a drive belt that engages a rotatable cam shaft attached to the base element that connects to the third body portion.

12. The apparatus as set forth in claim 11 wherein the drive motor drives the drive belt to rotate the cam shaft to move the third body portions in a vertical direction such that, when the printheads are aligned with the capping elements, the sealing elements are brought into contact with the printheads and forces are selectively exerted on the printheads by the spring mechanisms through the sealing elements.

13. The apparatus as set forth in claim 12 wherein the valves are opened or closed by the cam shaft rotating to move the valve vertically.

14. The apparatus as set forth in claim 13 wherein a flow of ink is established in the printheads when the forces are exerted and the valves are closed.

15. The apparatus as set forth in claim 9 wherein the valve comprises a wiping blade.

16. An apparatus for use with an acoustic ink printhead comprising:

at least one capping element aligned with the printhead, the capping element having a chamber defined therein, a valve positioned in the chamber, and a sealing element disposed around a periphery of the chamber;

means for moving the sealing element of the capping element into engagement with the printhead such that the sealing element touches the printhead but transmits substantially no force on the printhead;

means for closing the valve;

means for exerting a force on the sealing element to seal the chamber such that the force is transmitted to the printhead through the sealing element;

means for opening the valve;

means for removing the force on the capping element to remove the force on the printhead; and, means for moving the sealing element out of engagement with the printhead.

17. The apparatus as set forth in claim 16 wherein the means for moving the sealing element and for opening and closing the valve comprises a belt connecting a drive motor to a cam shaft that is connected to the capping element such that the drive motor drives the belt and the cam shaft rotates and moves the capping element in a vertical direction.

18. The apparatus as set forth in claim 17 wherein the means for exerting the force on the sealing element comprises spring mechanisms disposed within the capping element.

19. The apparatus as set forth in claim 16 wherein an air cushion is generated within the chamber by the exerting means thereby facilitating establishing the ink flow.

20. The apparatus as set forth in claim 16 wherein the valve opens in a direction toward the printhead.

21. The apparatus as set forth in claim 16 wherein the means for moving the sealing element comprises a lever rotatably connected to a cam shaft that is connected to the capping element such that the cam shaft rotates and moves the capping element in a vertical direction.

* * * * *